US006474293B1

(12) United States Patent
Bauer et al.

(10) Patent No.: US 6,474,293 B1
(45) Date of Patent: Nov. 5, 2002

(54) METHOD FOR OPERATING AN INTERNAL COMBUSTION ENGINE

(75) Inventors: Hartmut Bauer, Gerlingen; Dieter Volz, Heilbronn, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/720,241

(22) PCT Filed: Jun. 12, 1999

(86) PCT No.: PCT/DE99/01724

§ 371 (c)(1),
(2), (4) Date: Dec. 22, 2000

(87) PCT Pub. No.: WO99/67523

PCT Pub. Date: Dec. 29, 1999

(30) Foreign Application Priority Data

Jun. 24, 1998 (DE) ..... 198 28 085

(51) Int. Cl.[7] ..... F02B 17/00; F02D 41/14; F02D 41/38

(52) U.S. Cl. ..... 123/295; 123/687

(58) Field of Search ..... 123/295, 305, 123/478, 480, 679, 687

(56) References Cited

U.S. PATENT DOCUMENTS 5,078,107 A 1/1992 Morikawa et al. ..... 123/295
5,755,198 A 5/1998 Harmut et al. ..... 123/295
6,202,624 B1 * 3/2001 Stuerz et al. ..... 123/295

FOREIGN PATENT DOCUMENTS

| | | |
|---|---|---|
| DE | 196 31 986 | 2/1998 |
| DE | 197 46 902 | 4/1999 |
| EP | 0 898 069 | 2/1999 |

* cited by examiner

*Primary Examiner*—Tony M. Argenbright
(74) *Attorney, Agent, or Firm*—Walter Ottesen

(57) ABSTRACT

An internal combustion engine (1), especially for a motor vehicle, is described. The engine is provided with an injection valve (8) with which fuel can be injected directly into a combustion chamber (4) in a first operating mode during a compression phase or in a second mode of operation during an induction phase. A control apparatus (16) is provided for switching over between the two modes of operation and for the different control (open loop and/or closed loop) in the two modes of operation of the operating variables, which influence the outputted torque of the engine (1), in dependence upon a requested torque (mi). The fuel mass, which is to be injected in the first mode of operation, can be determined by the control apparatus (16) in dependence upon the operating parameters of the engine (1) which form the basis of the injections of the second operating mode.

13 Claims, 3 Drawing Sheets

METHOD FOR OPERATING AN INTERNAL COMBUSTION ENGINE

FIELD OF THE INVENTION

The invention relates to a method for operating an internal combustion engine, especially of a motor vehicle, wherein fuel is directly injected into a combustion chamber either in a first operating mode during a compression phase or in a second operating mode during an induction phase. In the method, a switchover is made between the two modes of operation and the operating variables, which influence the outputted torque of the engine, are controlled (open loop and/or closed loop) differently in the two operating modes in dependence upon the demanded torque. Furthermore, the invention relates to an internal combustion engine, especially for a motor vehicle, having an injection valve with which fuel can be injected directly into a combustion chamber either in a first operating mode during a compression phase or in a second operating mode during an induction phase. The engine includes a control apparatus for switching over between the two modes of operation and for different control (open loop and/or closed loop) in the two modes of operation of the operating variables in dependence upon a requested torque. The operating variables influence the outputted torque of the engine.

BACKGROUND OF THE INVENTION

Systems of this kind for direct injection of fuel into the combustion chamber of an internal combustion engine are generally known. A so-called stratified charge operation as first operating mode and a so-called homogeneous operation as second operating mode are distinguished. The stratified charge operation is used especially for smaller loads; whereas, the homogeneous operation is used for larger loads applied to the engine.

In stratified charge operation, the fuel is injected into the combustion chamber during the compression phase of the engine in such a manner that, at the time point of the ignition, a fuel cloud is located in the direct vicinity of the spark plug. This injection can take place in different ways. Thus, it is possible that the injected fuel cloud is already located at the spark plug during or directly after the injection and is ignited by the spark plug. Likewise, it is possible that the injected fuel cloud is conducted to the spark plug via a charge movement and is only then ignited. In both combustion methods, no uniform fuel distribution is present, instead, a stratified charge is present.

The advantage of the stratified charge operation is that there, with a very small fuel quantity, the applied smaller loads can be taken care of by the engine. Larger loads can, however, not be satisfied with the stratified operation.

In homogeneous operation, which is provided for such larger loads, the fuel is injected during the induction phase of the engine so that a swirling and therefore a distribution of the fuel can still easily take place in the combustion chamber. To this extent, the homogeneous operation corresponds approximately to the operation of internal combustion engines wherein fuel is injected into the intake manifold in the conventional manner. As required, the homogeneous operation can be used also for smaller loads.

In stratified charge operation, the throttle flap in the intake manifold, which leads to the combustion chamber, is opened wide and the combustion is essentially controlled (open loop and/or closed loop) only by the fuel mass to be injected. In homogeneous operation, the throttle flap is opened or closed in dependence upon the requested torque and the fuel mass, which is to be injected, is controlled (open loop and/or closed loop) in dependence upon the inducted air mass.

In both operating modes, that is, in the stratified charge operation and the homogeneous operation, the fuel mass, which is to be injected, is additionally controlled (open loop and/or closed loop) in dependence upon a plurality of additional operating variables with a view to an optimal value with respect to fuel saving, exhaust-gas reduction and the like. The control (open loop and/or closed loop) is then different in the two operating modes.

In the control (open loop and/or closed loop) of direct-injecting internal combustion engines, each of the two operating modes should be considered separately. Likewise, it should be guaranteed that, for the switchover especially from the homogeneous operation into the stratified charge operation, the torque, which is outputted by the engine, remains constant.

SUMMARY OF THE INVENTION

It is an object of the invention to provide a method for operating an internal combustion engine which makes possible a switchover from the second into the first mode of operation which is constant as to torque.

This object is solved with a method in accordance with the invention and/or with an internal combustion engine in accordance with the invention in that the fuel mass which is to be injected in the first operating mode is determined or can be determined in dependence upon the parameters of the engine which form the basis of the injections of the second mode of operation.

With the use of operating variables of the homogeneous operation with the control (open loop and/or closed loop) of the stratified charge operation, the possibility is provided that, when switching over from the homogeneous operation into the stratified charge operation, a switchover jolt because of the torque differences can be avoided. In this way, the smooth running of the engine and the comfort for the driver of the motor vehicle is increased.

Furthermore, the control (open loop and/or closed loop) of the stratified charge operation takes place on the basis of the control (open loop and/or closed loop) of the homogeneous operation. From this, the advantage is provided that the control (open loop and/or closed loop) of the homogeneous operation, especially the software modules or the like required therefor, can be taken over from known internal combustion engines which are operated only in homogeneous operation. In this way, it is only necessary to set the control (open loop and/or closed loop) for the new additional stratified charge operation. This control (open loop and/or closed loop) is then "superposed" on the known software modules so that, in total, a control (open loop and/or closed loop) is provided for a direct-injecting engine.

In an advantageous embodiment of the invention, the fuel mass, which is to be injected in the first mode of operation, is determined in dependence upon a lambda control factor of the second operating mode. This is one of several possibilities with which a constant torque can be achieved when switching over from the homogeneous operation into the stratified charge operation.

It is especially advantageous when the lambda control factor is changed by means of a time-dependent and/or rpm-dependent characteristic line.

In a further advantageous embodiment of the invention, the lambda control factor of the second mode of operation is stored. This defines a measure which makes possible a torque-constant switchover from the stratified charge operation back into the homogeneous operation.

In a further advantageous embodiment of the invention, the fuel mass, which is to be injected in the first mode of operation, is determined in dependence upon an intake air temperature and/or an ambient pressure. In this way, the switchover from the homogeneous operation into the stratified charge operation can be further improved in the sense of a constant torque.

In an advantageous embodiment of the invention, the fuel mass, which is to be injected in the first operating mode, is determined in dependence upon the requested torque. Here, it is especially advantageous when the requested torque is changed by means of an rpm-dependent characteristic line and/or when the requested torque is changed in dependence upon a specific thermal value of the fuel and/or an efficiency of the combustion of the engine in the first operating mode.

The realization of the method of the invention in the form of a control element is of special significance. The control element is provided for a control apparatus of the engine, especially of a motor vehicle. A program is stored on the control element which can be run on a control apparatus, especially on a microprocessor, and is suitable for carrying out the method of the invention. In this case, the invention is therefore realized by a program which is stored on the control element so that this control element, which is provided with the program, defines the invention in the same way as the method for whose execution the program is suitable. As a control element, especially an electric storage medium can be used, such as a read-only-memory.

Further features, application possibilities and advantages of the invention become evident from the description of the embodiments of the invention which follows and which are shown in the drawing. All features, which are described or illustrated, are, for themselves or in any desired combination, the subject matter of the invention independently of their composition in the patent claims or their dependency as well as independent of their formulation or illustration in the description or in the drawing.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
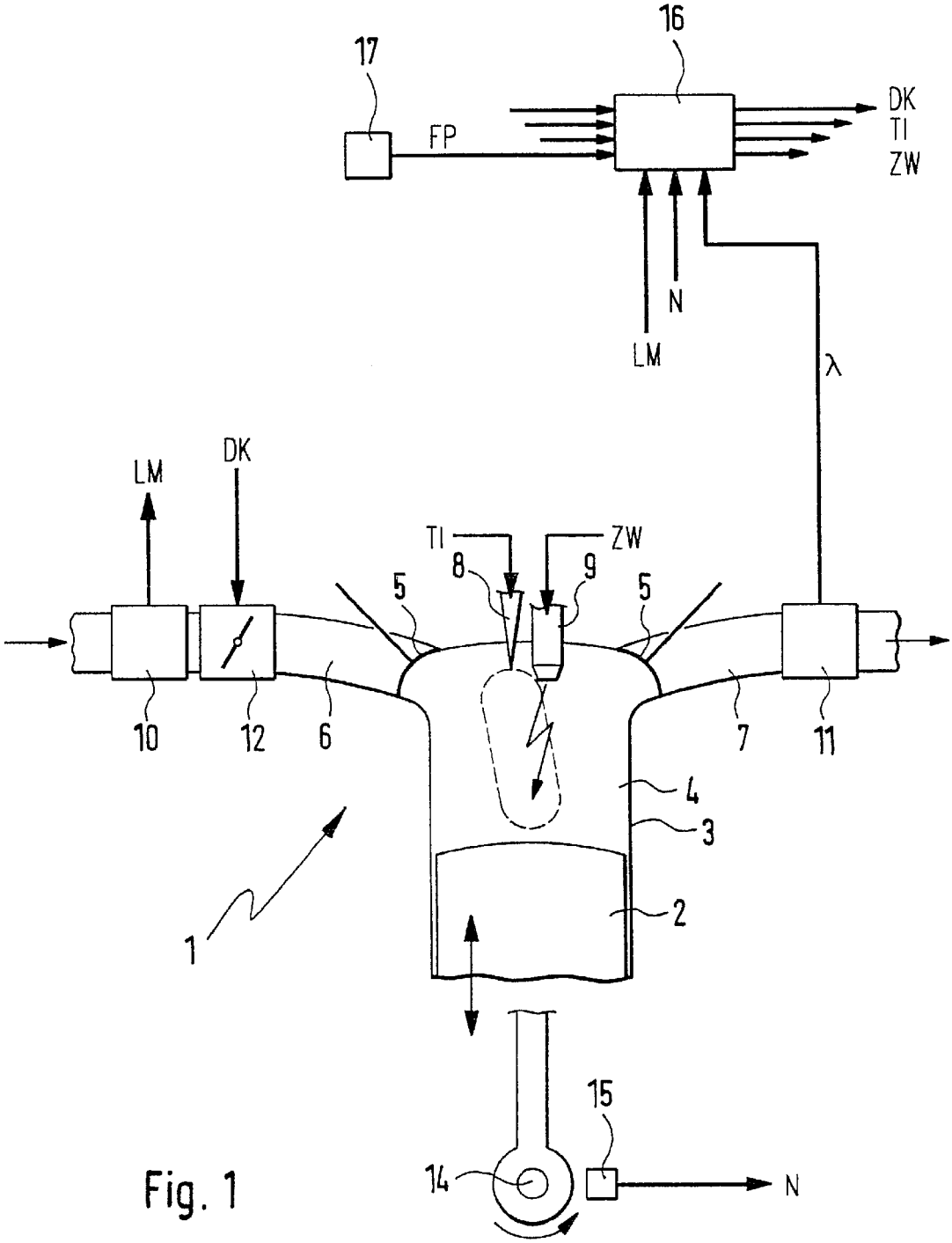
FIG. 1 shows a schematic block circuit diagram of an embodiment of an internal combustion engine of a motor vehicle in accordance with the invention.

In FIG. 1, an internal combustion engine 1 is shown wherein a piston 2 is movable back and forth in a cylinder 3. The cylinder 3 is provided with a combustion chamber 4 to which an intake manifold 6 is connected via valve 5 and an exhaust-gas pipe 7 is connected via valve 5. Furthermore, an injection valve 8 and a spark plug 9 are assigned to the combustion chamber 4. The injection valve 8 is driven with a signal TI and the spark plug 9 is driven by a signal ZW.

The intake manifold 6 is provided with an air mass sensor 10 and the exhaust-gas pipe 7 can be provided with a lambda sensor 11. The air mass sensor 10 measures the air mass of the fresh air, which is supplied to the intake manifold 6, and generates a signal LM in dependence thereon. The lambda probe 11 measures the oxygen content of the exhaust gas in the exhaust-gas pipe 7 and generates a signal $\lambda$ in dependence thereon.

A throttle flap 12 is accommodated in the intake manifold 6 and its rotational position can be adjusted by means of a signal DK.

In a first operating mode, the stratified charge operation of the engine 1, the throttle flap 12 is opened wide. The fuel is injected into the combustion chamber 4 by the injection valve 8 during a compression phase caused by the piston 2 and is injected locally in the direct vicinity of the spark plug 9 as well as at a suitable spacing in time in advance of the ignition time point. Then, the fuel is ignited with the aid of the spark plug 9 so that the piston 2 is driven in the now following work phase by the expansion of the ignited fuel.

In a second operating mode, the homogeneous operation of the engine 1, the throttle flap 12 is partially opened or closed in dependence upon the desired supplied air mass. The fuel is injected into the combustion chamber 4 by the injection valve 8 during an induction phase caused by the piston 2. With the simultaneously drawn-in air, the injected fuel is swirled and thereby essentially uniformly distributed in the combustion chamber 4. Thereafter, the air/fuel mixture is compressed during the compression phase in order to then be ignited by the spark plug 9. The piston 2 is driven by the expansion of the ignited fuel.

In stratified charge operation, as in homogeneous operation, rotational movement is imparted to a crankshaft 14 by the driven piston. The wheels of the vehicle are then driven by this rotational movement. An rpm sensor is assigned to the crankshaft 14 and this sensor generates a signal N in dependence upon the rotational movement of the crankshaft 14.

The fuel mass, which is injected into the combustion chamber 4 by the injection valve 8 in stratified charge operation and in the homogeneous operation, is controlled (open loop and/or closed loop) by a control apparatus 16 especially in view to a reduced consumption of fuel and/or a reduced development of toxic substances. For this purpose, the control apparatus 16 is provided with a microprocessor which has a program stored in a memory medium, especially in a read-only-memory. The program is suitable to carry out the above-mentioned control (open loop and/or closed loop).

Input signals are applied to the control apparatus 16 which define operating variables of the engine measured by means of sensors. For example, the control apparatus 16 is connected to the air mass sensor 10, the lambda sensor 11 and the rpm sensor 15. Furthermore, the control apparatus 16 is connected to an accelerator pedal sensor 17 which generates a signal FP which indicates the position of an accelerator pedal which is actuated by a driver and thereby indicates the torque requested by the driver. The control apparatus 16 generates output signals with which the performance of the engine can be influenced in correspondence to the desired control (open loop and/or closed loop). For example, the control apparatus 16 is connected to the injection valve 8, the spark plug 9 and the throttle flap 12 and generates the signals TI, ZW and DK required for the control of the injection valve, spark plug and throttle flap.

The method for controlling (open loop and/or closed loop) the homogeneous operation and a stratified charge operation is carried out by the control apparatus 16 as will be explained hereinafter with respect to FIGS. 2 and 3. The blocks shown in FIGS. 2 and 3 define functions of the method which, for example, are realized in the form of software modules or the like in the control apparatus 16.

Figure 2:
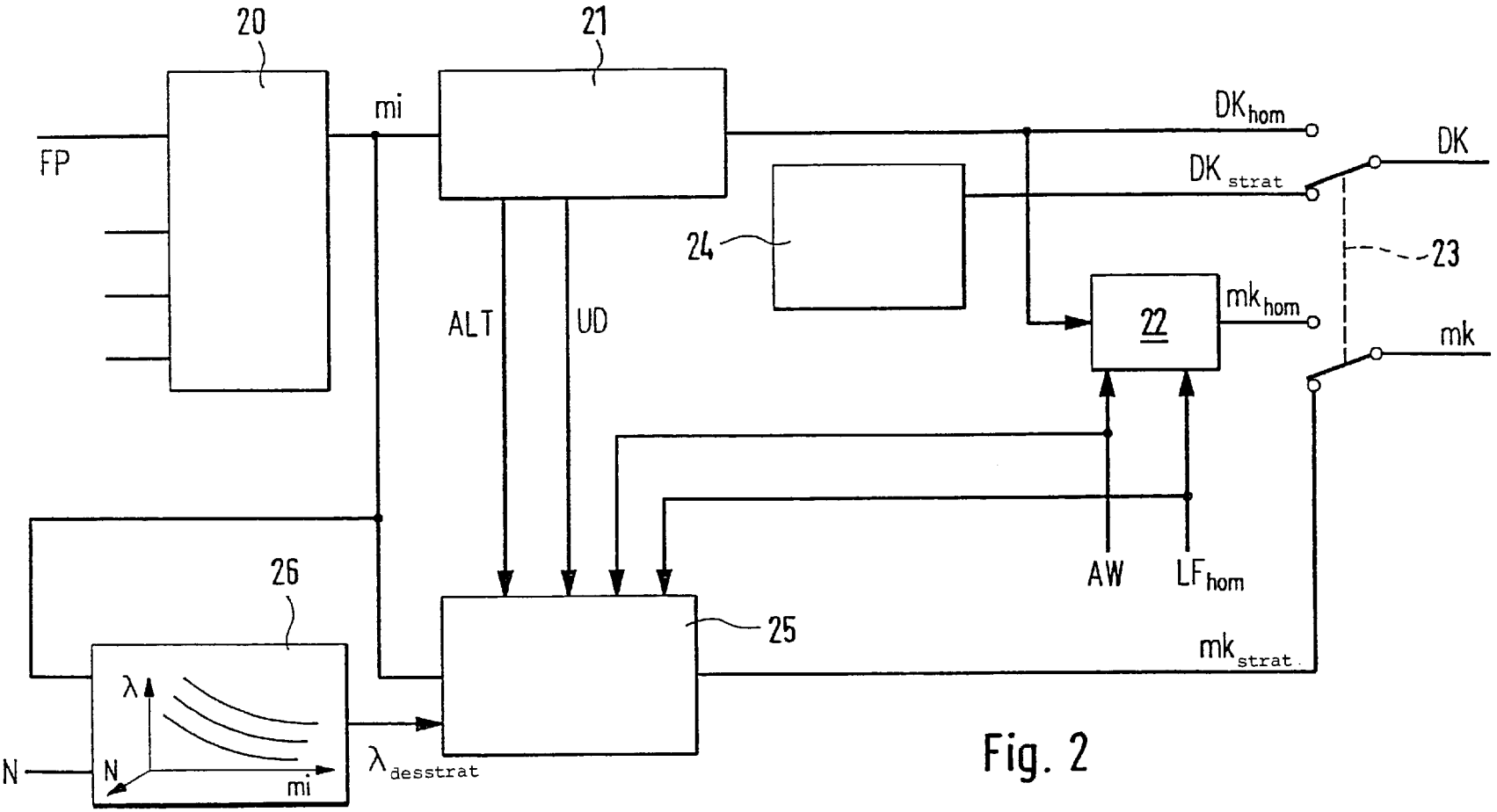
FIG. 2 shows a schematic sequence diagram of an embodiment of a method of the invention for operating the internal combustion engine of FIG. 1; and, FIG. 3 is a schematic sequence diagram of a portion of the method of FIG. 2 in detail.

In FIG. 2, a torque coordination is carried out in block 20. This means that a so-called indicated torque mi is determined from a plurality of input-end torque requests and this torque defines the total torque requested from the engine 1. The input-end torque request can be, for example, the signal FP which is generated by the accelerator pedal sensor 17 and which defines the torque requested by the driver.

The indicated torque mi is supplied to a charge control 21 (open loop and/or closed loop) which generates a signal DKhom in dependence upon the indicated torque mi and, if required, in dependence upon a plurality of additional operating variables of the engine 1. The signal DKhom serves to drive the throttle flap 12 in homogeneous operation. With the aid of the charge control (open loop and/or closed loop) 21, the throttle flap 12 is influenced in such a manner that the desired torque is generated and outputted by the engine 1.

The signal DKhom is supplied to a fuel control (open loop and/or closed loop) 22 which generates a signal mkhom in dependence upon the signal DKhom and other operating variables of the engine 1. The signal mkhom corresponds to the fuel mass which is to be injected by the injection valve 8 in homogeneous operation. The other operating variables can be, for example, a lambda control factor for the homogeneous operation LFhom and adapted values AW, which are essential for the homogeneous operation.

If the engine 1 is in homogeneous operation, then a switch 23 is switched over into the position for the homogeneous operation shown in FIG. 2. In this way, the signals DKhom and mkhom are transmitted further as drive signals DK and mk for the throttle flap 12 and for the injection valve 8. The signal mk, that is, the fuel mass which is to be injected, is converted into a signal TI with which the injection valve is driven.

The configuration described until now for the control (open loop and/or closed loop) of the engine 1 corresponds to that control (open loop and/or closed loop) which is used in known internal combustion engines which are driven only in the homogeneous operation. The known software modules or the like can therefore be taken over and used further in the present control (open loop and/or close loop).

If the described engine 1 is to be operated in stratified charge operation, then the switch 23 is switched over into the position shown in FIG. 2.

In FIG. 2 a throttle flap control (open loop and/or closed loop) 24 is provided which, if required, generates a signal DKstrat in dependence upon operating variables of the engine 1. The signal is transmitted via switch 23 to the throttle flap 12 as signal DK. This signal DKstrat serves to adjust the throttle flap 12 in the stratified charge operation.

The throttle flap control (open loop and/or closed loop) 24 can be, for example, a characteristic line with which the signal DKstrat is determined in dependence upon the rpm. Likewise, it is possible that the signal DKstrat is controlled (open loop and/or closed loop) in dependence upon a difference pressure across the throttle flap 12. It is important that the throttle flap is opened so wide in stratified charge operation that the engine 1 can run from slightly dethrottled to fully dethrottled.

A correction block 25 is provided in FIG. 2, which generates a signal mkstrat in dependence upon the indicated torque mi and a plurality of additional input variables. The signal mkstrat defines the fuel mass to be injected during stratified charge operation. If the switch 23 is in the position for stratified charge operation, then the signal mkstrat is transmitted to the injection valve 8 as the fuel mass mk which is to be injected.

The indicated torque mi is supplied to a $\lambda$ desired stratified characteristic field 26 to which the rpm N of the engine 1 is likewise applied. The $\lambda$ desired stratified characteristic field 26 generates a signal $\lambda_{desstrat}$ in dependence upon the indicated torque mi and the rpm N which serves to correct a throttling of the engine required, for example, because of an exhaust-gas recirculation or tank venting. Such a throttling operates on the generated torque and on the air/fuel mixture. With the signal $\lambda_{desstrat}$, this influence is compensated especially in the sense of a torque constancy when switching over from the homogeneous operation into the stratified charge operation.

Figure 3:
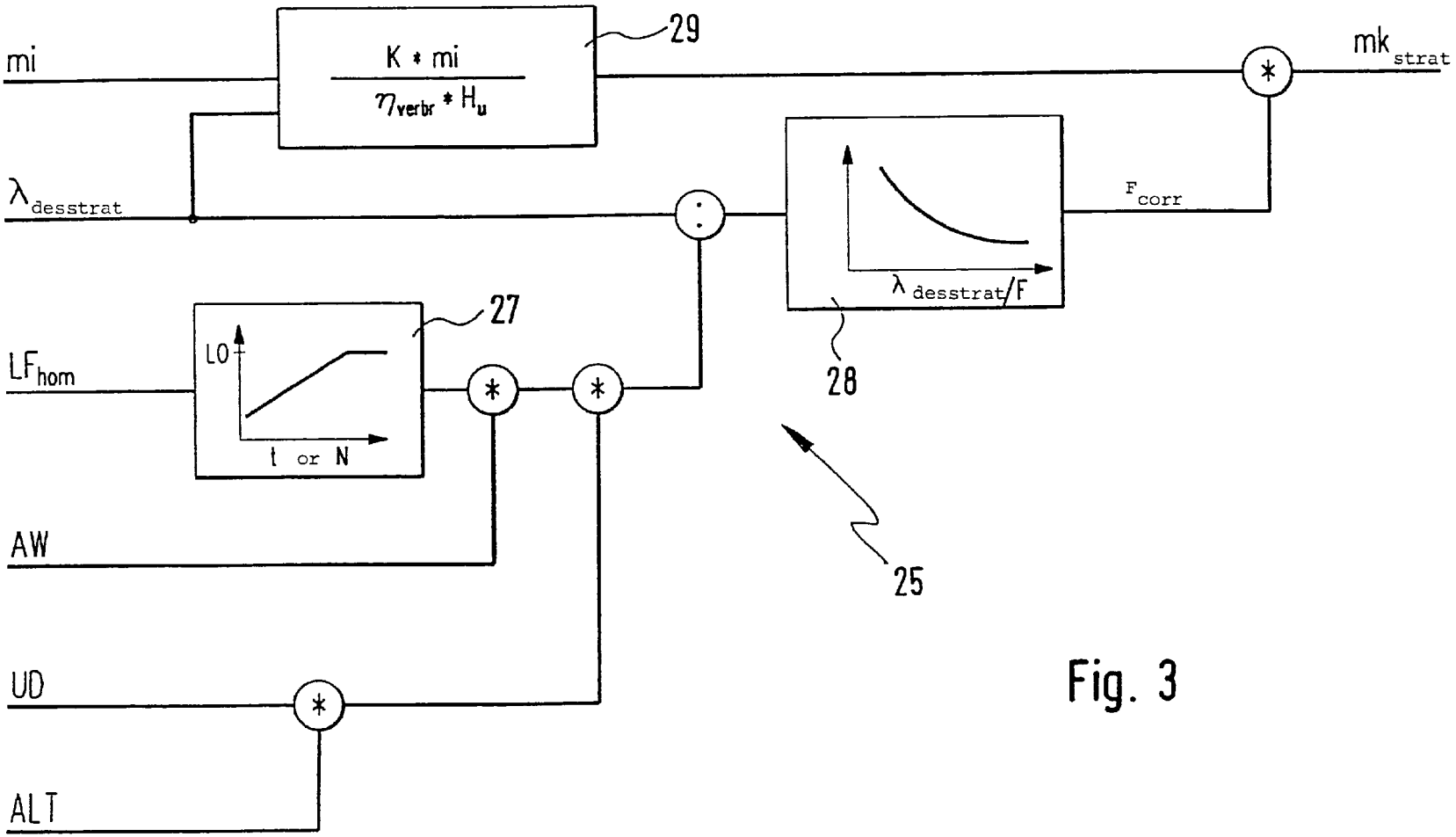

The correction block 25 is shown in detail in FIG. 3. The following are supplied to the correction block 25: the signal $\lambda_{desstrat}$, the indicated torque mi, the adapted values AW for the homogeneous operation, the lambda control factor LFhom for the homogeneous operation, the intake air temperature ALT and an ambient pressure UD.

The lambda control factor LFhom for the homogeneous operation is stored after a switchover into the stratified charge operation and thereby frozen. Independently of the above, this lambda control factor LFhom is applied as a corrective quantity in the computation of the fuel mass for the stratified charge operation in correspondence to FIG. 3.

According to FIG. 3, the lambda control factor LFhom is supplied to a characteristic line 27 which carries out an influencing thereof in dependence upon time and/or rpm. This is especially required when the known control (open loop and/or closed loop) for the homogeneous operation requires, when there is a load change, a start value for the lambda control after a return switching into the homogeneous operation. The changed lambda control factor is, in this case, used as the start value after the switchover into the homogeneous operation.

It is, however, likewise possible that the lambda control factor LFhom is retained in the stratified charge operation. In this case, a larger or smaller fuel mass, which is to be injected, can be caused by changes at the injection valve 8.

The output signal of the characteristic line 27 is multiplicatively coupled in correspondence to FIG. 3 with the adapted values AW, the ambient pressure UD and the intake temperature ALT to form a signal F. The signal $\lambda_{desstrat}$ is divided by the result of these multiplications. The result of this division is supplied to block 28 of FIG. 3 which serves to consider the difference of the efficiency of the homogeneous operation and of the stratified charge operation.

In block 28, a corrective factor Fcorr is determined from the division result of $\lambda_{desstrat}$/F with the aid of a characteristic line. This corrective factor defines the above-mentioned efficiency difference between the homogeneous operation and the stratified charge operation. This corrective factor Fcorr is used to correct the fuel mass which should be injected in the stratified charge operation.

This fuel mass, which should be injected, is computed in accordance with FIG. 3 from the indicated torque mi in block 29 in accordance with the equation:

$$K*mi/\eta verbr*Hu.$$

Here, $\eta$verbr corresponds to the efficiency of the combustion in the stratified charge operation, Hu corresponds to the specific thermal value of the fuel and K is a constant.

The output signal of the block 29, that is, the fuel mass, which is to be injected, is multiplicatively coupled to the corrective value Fcorr. The output signal of the block 29, which has until now only considered the efficiency of the stratified charge operation, is, in this way, corrected in dependence upon the explained efficiency difference between the homogeneous operation and the stratified charge operation. From this, there results the fuel mass mkstrat which is to be injected during stratified charge operation. As already mentioned, this signal mkstrat is transmitted via the switch as a fuel mass mk, which is to be injected, to the injection valve 8. The switch is switched over in correspondence to the stratified charge operation.

What is claimed is:

1. A method for operating an internal combustion engine including an engine of a motor vehicle, the method comprising the steps of;

injecting fuel directly into a combustion chamber either in a first operating mode during a compression phase or in a second operating mode during an induction phase;

switching over between the two operating modes;

controlling the operating variables, which influence the outputted torque of the engine, differently in the two operating modes in dependence upon the requested torque (mi); and, determining the fuel mass (mkstrat), which is to be injected in the first operating mode, in dependence upon a lambda controller factor (LFhom) of the second operating mode and in dependence upon additional operating parameters of the engine which form the basis of the injections of the second operating mode.

2. The method of claim 1, comprising the further step of changing the lambda controller factor (LFhom) via at least one of a time-dependent characteristic line, an rpm-dependent characteristic line and a time-dependent and rpm-dependent characteristic line.

3. The method of claim 1, comprising the further step of storing the lambda controller factor (Lmhom) of the second operating mode.

4. The method of claim 1, comprising the further step of determining the fuel mass (mkstrat), which is to be injected in the first operating mode, in dependence upon at least one of an intake air temperature (ALT) and an ambient pressure (UD).

5. The method of claim 1, comprising the further step of determining the fuel mass (mkstrat), which is to be injected in the first operating mode, in dependence upon the requested torque (mi).

6. The method of claim 5, comprising the further step of changing the requested torque (mi) via an rpm-dependent characteristic field.

7. The method of claim 6, comprising the further step of determining the requested torque (mi) in dependence upon at least one of a specific thermal value (Hu) of the fuel and an efficiency (ηverbr) of the combustion of the engine in the first operating mode.

8. The method of claim 1, wherein said operating variables are controlled utilizing at least one of an open loop and a closed loop control.

9. A program comprising:

instructions recorded on a computer-readable medium for carrying out a method for operating an internal combustion engine including an engine of a motor vehicle when said program is executed on a computing apparatus and the method including the steps of:

injecting fuel directly into a combustion chamber either in a first operating mode during a compression phase or in a second operating mode during an induction phase;

switching over between the two operating modes;

controlling the operating variables, which influence the outputted torque of the engine differently in the two operating modes in dependence upon the requested torque (mi); and, determining the fuel mass (mkstrat), which is to be injected in the first operating mode, in dependence upon a lambda controller factor (LFhom) of the second operating mode and in dependence upon additional operating parameters of the engine which form the basis of the injections of the second operating mode.

10. The program of claim 9, wherein said program is stored in a memory.

11. The program of claim 9, wherein said operating variables are controlled utilizing at least one of an open loop and a closed loop control.

12. An internal combustion engine including an engine for a motor vehicle, the engine comprising:

an injection valve with which fuel can be injected directly into a combustion chamber of the engine, either in a first operating mode during a compression phase, or in a second operating mode during an induction phase;

a control apparatus for switching over between the two modes of operation and for controlling the operating variables, which influence the outputted torque of the engine, differently in the two operating modes in dependence upon a requested torque (mi); and, said control apparatus including means for determining the fuel mass (mkstrat), which is to be injected in the first operating mode, in dependence upon a lambda controller factor (LFhom) of the second operating mode and in dependence upon the additional operating parameters of the engine which form the basis of the injections of the second operating mode.

13. The internal combustion engine of claim 12, wherein said operating variables are controlled utilizing at least one of an open loop and a closed loop control.

* * * * *